US005905235A

United States Patent [19]

Charman

[11] Patent Number: 5,905,235

[45] Date of Patent: May 18, 1999

[54] KEY ASSEMBLY

[75] Inventor: Neil Charman, Surrey, United Kingdom

[73] Assignee: Nokia Mobile Phones, Ltd., Camberley, United Kingdom

[21] Appl. No.: 08/971,459

[22] Filed: Nov. 17, 1997

Related U.S. Application Data

[63] Continuation of application No. 08/652,832, May 23, 1996, abandoned.

[30] Foreign Application Priority Data

May 27, 1995 [GB] United Kingdom ..... 9510849

[51] Int. Cl.[6] ..... H01H 13/70; H01H 3/12

[52] U.S. Cl. ..... 200/5 A; 200/517

[58] Field of Search ..... 200/5 A, 512–517, 200/329, 341–345

[56] References Cited

U.S. PATENT DOCUMENTS

| | | | |
|---|---|---|---|
| 3,783,205 | 1/1974 | Boulanger | 200/5 A |
| 3,829,646 | 8/1974 | Lorteije et al. | 200/5 A X |
| 4,194,105 | 3/1980 | Hodges | 200/517 |
| 4,476,355 | 10/1984 | Mital | 200/5 A |
| 4,518,833 | 5/1985 | Watkins | 200/5 A X |
| 4,540,865 | 9/1985 | Calder | 200/5 A X |
| 4,554,426 | 11/1985 | Caste | 200/517 |
| 4,677,268 | 6/1987 | Nemeth et al. | 200/513 |
| 4,766,271 | 8/1988 | Mitsuhashi et al. | 200/5 A |
| 4,778,952 | 10/1988 | Watkins et al. | 200/292 X |
| 4,924,046 | 5/1990 | Howard | 200/516 |
| 5,266,949 | 11/1993 | Rossi | 341/22 |
| 5,408,060 | 4/1995 | Muurinen | 200/314 |
| 5,510,584 | 4/1996 | Norris | 200/5 A |

FOREIGN PATENT DOCUMENTS

| | | |
|---|---|---|
| 2 046 996 | 11/1980 | United Kingdom . |
| 2 073 494 | 10/1981 | United Kingdom . |

*Primary Examiner*—J. R. Scott
*Attorney, Agent, or Firm*—Perman & Green, LLP

[57] ABSTRACT

A key assembly (10) comprises a depressible key (16) having a depending projection (22), a pair of electrical terminals (36), and a domed contact membrane (30) snappable between two positions for making and breaking electrical connection between the electrical terminals. The depression of the key (16) causes the projection (22) to urge the contact membrane (30) to snap from a first natural-bias position (FIG. 2(*a*)) in which the electrical terminals are not electrically connected to a second distorted position (FIG. 2(*b*)) in which the electrical terminals are connected. The projection comprises an annular flange confronting the contact membrane and laterally spaced apart from the apex (33) of the dome (32).

6 Claims, 4 Drawing Sheets

KEY ASSEMBLY

This application is a continuation of copending application Ser. No. 08/652,832 filed on May 23, 1996, now abandoned.

BACKGROUND OF THE INVENTION

The present invention relates to a key assembly having particular, but not exclusive, application to the field of mobile phones.

SUMMARY OF THE INVENTION

The present invention is particularly concerned with the sensation of movement or tactile feedback which a key of the key assembly affords a user during operation.

FIGS. 1(*a*) and 1(*b*) show cross-sectional views of a known key assembly which forms part of a known key pad assembly for a handportable radio telephone.

Referring to FIG. 1(*a*), the key assembly, generally designated 10, comprises a body portion 12 defining an aperture 14 and a key 16 mounted in register with the aperture. The key 16 is mounted relative to the body portion 12 by means of a skirt region 18 which is flexible and permits the movement of the key 16 into and out of the aperture 14, when it is depressed, but naturally biases it to occupy the position shown in FIG. 1(*a*). On their upper surfaces, the key 16, the body portion 12 and the skirt region 18 are painted; the upper surface of the key 16 includes an indicia region 19 which is painted so as to bear an indicia serving to indicate the function of the key 16, for example, an alphanumeric character or other symbol. The key 16 includes a base 20 from which a depending projection or pip 22 centrally projects. The pip 22 is cylindrical and has an exposed end 24. The key 16, including the pip 22, the body portion 12 and the skirt region 18 are made from a single piece of silicon rubber. The key assembly 10 further comprises a contact membrane 30 having a resiliently distortable dome 32, with an apex 33, which is snappable between bias positions. The membrane 30 is mounted, as shown in FIG. 1(*a*), such that a small spacing exists between the exposed end 24 and the outside surface of the dome 32. On the inside surface of the dome 32, there is provided a conductive carbon coating 34. In addition, the dome 32 houses a pair of spaced electrical terminals 36. The dome 32 is distortable so as to snap from a first natural-bias position in FIG. 1(*a*), in which the electrical terminals 36 are not electrically connected to each other to a second position, as shown in FIG. 1(*b*), in which the conductive carbon coating 34 on the inside of the dome 32 provides electrical connection between the electrical terminals 36.

In use, the user depresses the key 16 causing it to travel into the aperture 14 and thus the exposed end 24 of the pip 22 to bear against the dome 32. The continued travel of the pip 22 causes the continued distortion of the dome 32, until it reaches a condition at which it snaps into the second position shown in FIG. 1(*b*). The distance which the key 16 must be depressed from initial contact with the dome until the dome 32 reaches the point at which it snaps is referred to herein as the snap distance. The making of the electrical connect ion between the electrical terminals 36 enables external circuitry (not shown) to register the depression of the key 16.

As shown in FIG. 1(*b*), the region of the pip 22 which contacts the dome 32 and is designated 38 has a perimeter, substantially equal to the perimeter of the corresponding region, designated 38', in FIG. 1(*a*), due to the limited extent to which the distorted dome 32 is able to deform by compression the solid pip 22 during engagement therewith.

When the key 16 is fully depressed as in FIG. 1(*b*), the dome 32 is approaching a second bias position. However, the construction of the key assembly is arranged such that it cannot reach this position, Thus, when the key 16 is released, the resilience of the dome 32 propels the key 16 upwardly and the dome 32 resumes its first position as shown in FIG. 1(*a*). The resilience of the skirt region 18 then causes the key 16 to re-adopt its position in FIG. 1(*a*).

In one aspect, the present invention provides a key assembly comprising a depressible key having a depending projection;

a pair of electrical terminals;

and a domed contact membrane snappable between two positions for making and breaking electrical connection between the electrical terminals, wherein depression of the key causes the projection to urge the contact membrane to snap from a first natural-bias position in which the electrical terminals are not electrically connected to a second distorted position in which the electrical terminals are electrically connected;

characterised in that the projection comprises an annular flange confronting the contact membrane and laterally spaced apart from the apex of the dome.

The annular flange permits the compression of the projection during engagement with the contact membrane. In this way, the contact membrane is able to adopt a second position more favourable to its natural characteristics.

The annular flange, positioned as described above, also facilitates an increase in the snap distance of the key assembly of the present invention in comparison with the prior art key assembly absent the annular flange.

Preferably, the region of the projection which contacts the contact membrane when the contact membrane is in its second position has a smaller perimeter than when the contact member is in its first position, due to the compression of the projection by the contact membrane.

In a further aspect, the present invention provides a key pad comprising:

a substrate;

a plurality of keys mounted, for depression, to the substrate by a skirt portion, each key having a projection, wherein each projection includes an annular flange at its exposed end.

Subsidiary features of the invention are given in the dependent claims.

Throughout the specification, similar parts have been given the same or closely related reference numerals.

BRIEF DESCRIPTION OF THE DRAWINGS

Exemplary embodiments of the invention are hereinafter described with reference to the accompanying drawings, in which.

DESCRIPTION OF PREFERRED EMBODIMENTS

Figure 1A:
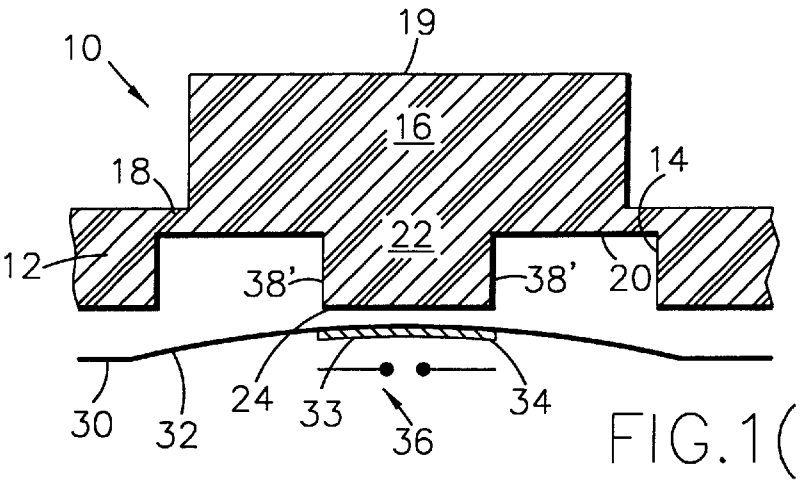
FIG. 1(A) (PRIOR ART)
FIGS. 1(*a*) and 1(*b*) show cross-sectional views of a known prior art key pad assembly.
Figure 1B:
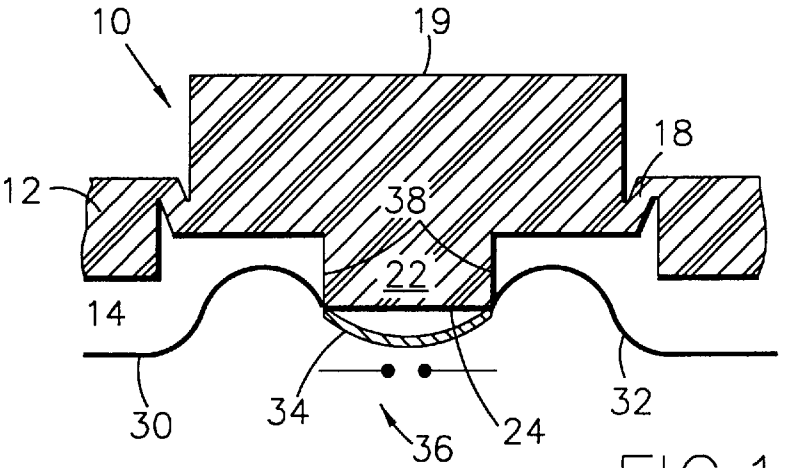
FIG. 1(B) (PRIOR ART)
Figure 2A:
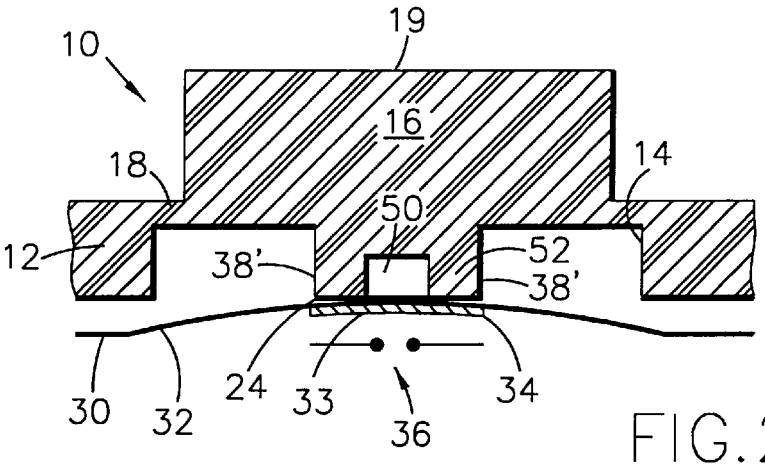
FIG. 2(*a*) and 2(*b*) show cross-sectional views of a key assembly in accordance with a first embodiment of the invention.
Figure 2B:
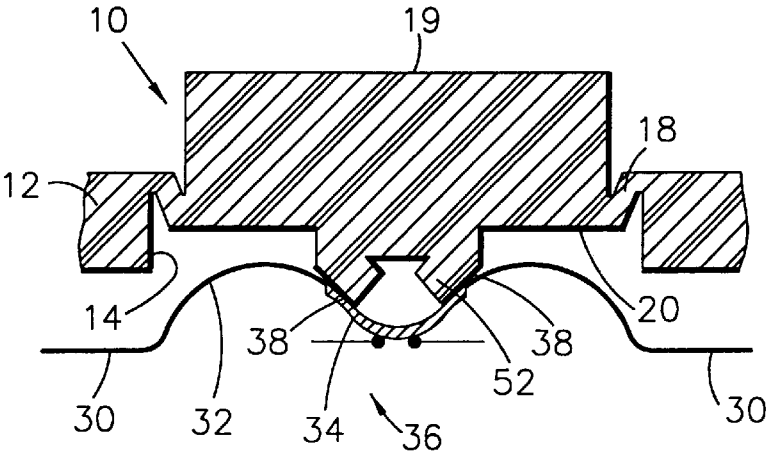
Figure 3:
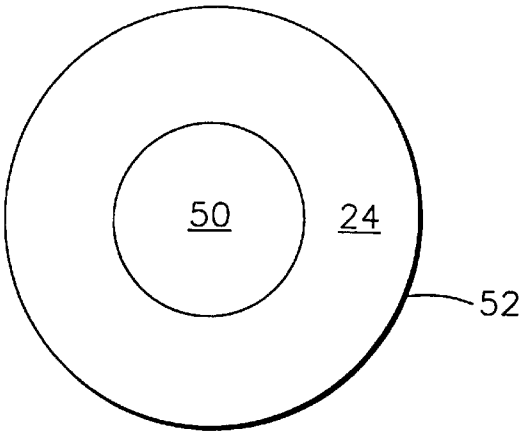
FIG. 3 shows a view of the exposed end of the pip of FIGS. 2(*a*) and 2(*b*) when viewed in plan.

FIG. 2(*a*) shows a view of a first embodiment of the invention corresponding to the FIG. 1(*a*) view of the prior art. The first embodiment is similar to the prior art of FIG. 1 except that (i) the pip 22 is provided with an annular flange 52 confronting the dome 32 and laterally spaced from the apex 33 of the dome 32 and (ii) in the first natural-bias position (FIGS. 2(*a*)), the key 16 rests in substantially unloaded contact against the dome 32 of the membrane 30. The annular flange 52 thus defines a cavity 50 centrally in the exposed end 24 of the pip 22 which extends partially along the length of the pip 22. FIG. 3 shows a view, in plan, of the exposed end 24 of the pip 22.

When the key 16 is depressed, the pip 22 is urged into loaded contact with the dome 32. The continued depression of the key 16 causes the dome 32 to distort until it reaches a condition at which it snaps into its second position in FIG. 2(*b*). Due to the arrangement of the annular flange 52 above and spaced laterally from the apex 33 of the dome 32, the snap distance of the key 16 is increased in comparison with the FIG. 1 key assembly, as the apex 33 of the dome 32 is not directly contacted by the pip 22.

It will be noted, from inspection of FIG. 2(*b*), that the region of the annular flange 52, which contacts the dome 32, designated 38, has a smaller perimeter than the corresponding region in FIG. 2(*a*) which is designated 38'. This reduction in the perimeter of the contact region 38 arises out of the provision of the annular flange 52 which enables the gripping force exerted by the distorted dome 32 on the pip 22 to bow or deform inwardly the annular flange wall 52. The inward deformation of the annular flange 52 promotes a more localised distortion of the dome 32 and allows the dome 32 to adopt a shape in its distorted state of FIG. 2(*b*) more favourable to its natural characteristics; in this way the work required to distort the dome 32 is reduced. On releasing the key 16, the resilience of the dome 32 propels the key 16 upwardly and the dome 32 resumes its first position as shown in FIG. 2(*a*) as does the key 16.

By virtue of the annular flange 52, the user of the key assembly 10 is provided with a more positive snapping sensation during operation. Further, it has been found by the applicant that the key assembly 10 in accordance with this first embodiment performs for more key depressions before failure than a comparable key assembly absent the annular flange. In this first embodiment of the invention, the pip 22 preferably has a diameter of 2 mm, and the cavity 50 a diameter of 1 mm and a depth of 0.3 mm.

Figure 4:
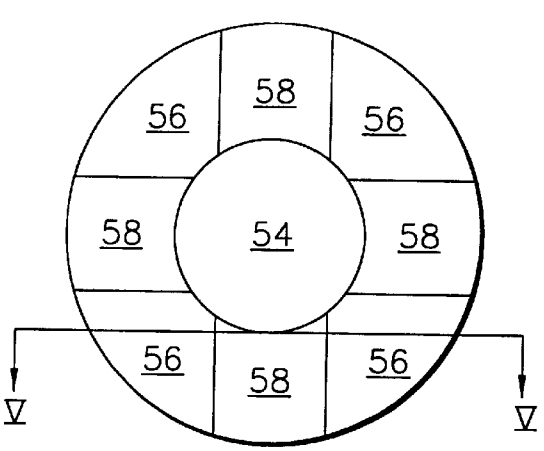
FIG. 4 shows a view of the exposed end of the pip of a second embodiment of the invention.
Figure 5:
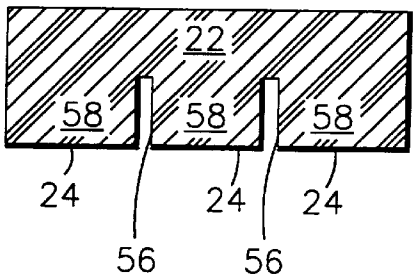
FIG. 5 shows a cross-sectional view of FIG. 4 taken on the line V—V.

FIGS. 4 and 5 show a second embodiment of the invention. In this embodiment which is identical to the first embodiment except that the annular flange 52 comprises four flange portions 58 defining a central cavity region 54 and four peripheral cavity regions 56, each of which is separated from a neighbouring peripheral cavity region 56 by one of the flange portions 58. Each of the cavity regions 54,56 extend partially along the length of the pip 22.

This second embodiment operates in a similar manner to the first embodiment. Notably, in the second position the four flange portions 58 are gripped inwardly in a similar manner to the flange 52 in FIG. 2(*b*).

Figure 7:
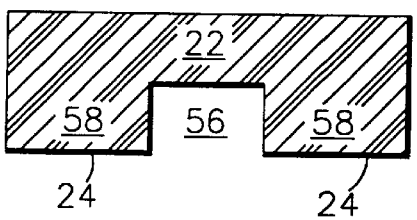
FIG. 7 shows is a cross-sectional view of FIG. 6 taken along the line VII—VII.
Figure 6:
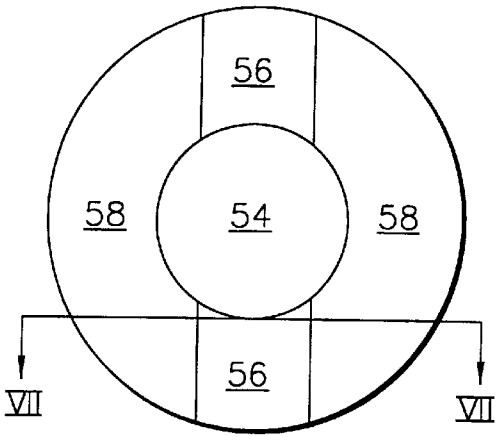
FIG. 6 shows a view of the exposed end of the pip of a third embodiment of the invention.

FIGS. 6 and 7 show a third embodiment of the invention. In this embodiment which is identical to the first embodiment except that the annular flange 52 comprises two opposed flange portions 58 defining a central cavity region 54 and two peripheral cavity regions 56 separated from each other by a flange portion 58. Each of the cavity regions 54,56 extend partially along the length of the pip 22.

This third embodiment operates in a similar manner to the first embodiment. Notably, in the second position the flange portions 58 are gripped inwardly toward one another in an analogous manner to the flange 52 in FIG. 2(*b*). This embodiment may suffer from the disadvantage that the tactile feedback afforded by the key assembly 10 is dependent on how the key 16 is depressed.

In other embodiments of the invention (not shown), the annular flange may extend along the whole length of the pip 22.

Figure 8:
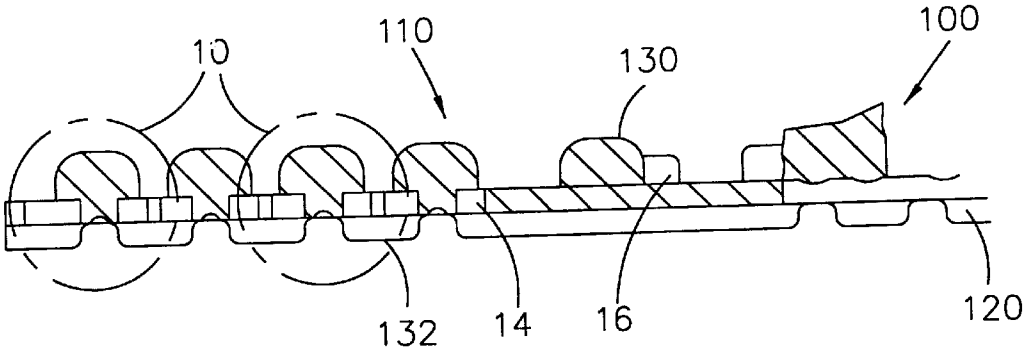
FIG. 8 shows a key pad assembly in accordance with the present invention in cross-section.
Figure 9:
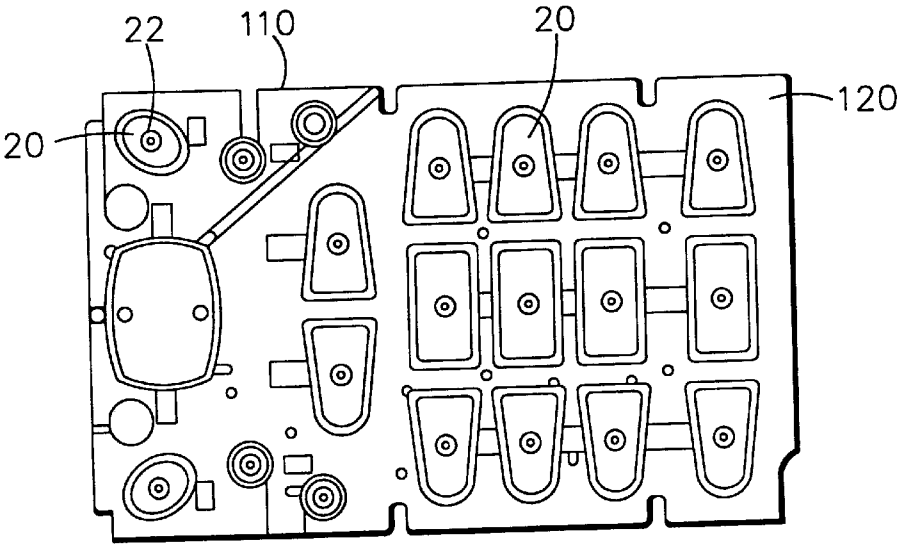
FIG. 9 shows a plan view from below the key pad shown in FIG. 8.

Referring to FIG. 8, a key pad assembly 100 for a handportable radio telephone in accordance with the present invention is shown employing a plurality of key assemblies 10 in accordance with the first embodiment of the invention. It may, of course, also be constructed using a key assembly in accordance with any other embodiment of the invention.

The key pad assembly 100 is implemented as a key pad 110 comprising a common substrate 120 defining a plurality of the apertures 14 into which a plurality the key 16 are mounted for movement; and a polydome membrane 130 comprising a plurality of the domes 32 mounted on a common carrier 132. The whole key pad 110 is made from an homogenous piece of silicon rubber.

We claim:

1. A key assembly comprising:

a depressible key having a depending projection;

a pair of electrical terminals; and a domed contact membrane snappable between two positions for making and breaking electrical connection between the electrical terminals;

wherein depression of the key causes the projection to urge the contact membrane to snap from a first natural-bias position in which the electrical terminals are not electrically connected to a second distorted position in which the electrical terminals are electrically connected;

characterized in that the projection comprises an annular flange confronting the contact membranes and laterally spaced apart from the apex of the dome;

the region of the annular flange which contacts the contact membrane when the contact membrane is in its second position has a smaller perimeter than when the contact member is in its first position; and wherein the annular flange comprises a plurality of flange portions which define a central cavity region and a plurality of peripheral cavity regions, each separated from a neighboring peripheral cavity region by a flange portion.

2. A key assembly comprising:

a pair of electrical terminals;

a domed contact membrane snappable between a first natural bias position in which the electrical terminals are not electrically connected and a second distorted position in which the electrical terminals are electrically connected; and a one-piece key element comprising a substrate and a key supported by the substrate for user depression thereof, the key including a face which the user can depress and a depending annular wall, defining a cavity, arranged to confront the contact membrane, wherein the depression of the key causes the annular wall to urge the contact membrane to snap to its second distorted position, the cavity allowing for inward compression of said wall during key depression.

3. A key assembly as in claim 2, wherein the region of the annular wall which confronts the contact membrane when the contact membrane is in its second position has a smaller perimeter than when the contact member is in its first position.

4. A key assembly as in claim 3, wherein the annular flange comprises a plurality of wall portions which define a central cavity region and a plurality of peripheral cavity regions, each separated from a neighboring peripheral cavity region by a flange portion.

5. A key pad assembly comprising a plurality of key assemblies according to claim 2.

6. An assembly comprising:

a plurality of keys mounted, for depression, to a substrate; and wherein each key includes a face which the user can depress and a depending annular wall, defining a cavity, arranged to confront a contact membrane, wherein the depression of the key causes the annular wall to urge the contact membrane to snap to its second distorted position, the cavity allowing for inward compression of said wall during key depression.

* * * * *